US006796633B1

(12) United States Patent
Kawamata et al.

(10) Patent No.: US 6,796,633 B1
(45) Date of Patent: Sep. 28, 2004

(54) INK-JET RECORDER AND METHOD FOR CLEANING RESTORING SYSTEM

(75) Inventors: Yutaka Kawamata, Tokyo (JP); Yasuyuki Takagi, Tokyo (JP); Tomohiro Ishitsu, Tokyo (JP)

(73) Assignee: Canon Finetech Inc., Ibaraki (JP)

( * ) Notice: Subject to any disclaimer, the term of this patent is extended or adjusted under 35 U.S.C. 154(b) by 0 days.

(21) Appl. No.: 10/312,102

(22) PCT Filed: Aug. 10, 2001

(86) PCT No.: PCT/JP01/06898

§ 371 (c)(1),
(2), (4) Date: Dec. 20, 2002

(87) PCT Pub. No.: WO02/14074

PCT Pub. Date: Feb. 21, 2002

(30) Foreign Application Priority Data

Aug. 11, 2000 (JP) ..... 2000-245118
Aug. 11, 2000 (JP) ..... 2000-245119

(51) Int. Cl.[7] ..... B41J 2/165

(52) U.S. Cl. ..... 347/23; 347/29; 347/30; 347/35

(58) Field of Search ..... 116/206, 200, 116/DIG. 41; 73/1.17, 40.5; 436/3, 161; 347/23, 14, 19, 22, 24, 29, 30, 32, 33, 35

(56) References Cited

U.S. PATENT DOCUMENTS 5,428,380 A * 6/1995 Ebisawa ..... 347/35
5,617,122 A * 4/1997 Numata et al. ..... 347/14
6,042,214 A * 3/2000 Minowa et al. ..... 347/23
6,042,218 A * 3/2000 Nakahara ..... 347/35

FOREIGN PATENT DOCUMENTS

EP 0 698 495 A2 * 2/1996
EP 0 850 765 A2 * 7/1998
JP 9-30004 2/1997
JP 10-278299 10/1998

* cited by examiner

*Primary Examiner*—Shih-Wen Hsieh
(74) *Attorney, Agent, or Firm*—Dellett & Walters

(57) ABSTRACT

Before starting printing and/or after finishing printing, a preliminary ejection of ink is performed for a cap, which covers a recording head, until the cap is almost filled (S17, S23, S38). Then, a sucking operation (S18, S24, S39) is performed to suck ink stored in the cap. Alternatively, based on a predetermined criterion such as the accumulated number of printed dots, the number of printed pages, or a print time (S71, S72), a first print operation (S73), which preliminarily ejects a predetermined amount of ink at least before starting printing or after printing, and a second print operation (S74), which preliminarily ejects more ink than the predetermined amount at least before starting printing or after printing, are alternately performed. This prevents ink from adhering to a restoring system of an ink-jet recorder and allows the sucking operation and the preliminary ejection operation to be performed smoothly.

14 Claims, 8 Drawing Sheets

FIG. 7

| DOT COUNT | $0\sim 11\times10^7$ | $11\times10^7 \sim 12\times10^7$ | $12\times10^7 \sim 23\times10^7$ | $23\times10^7 \sim 24\times10^7$ | . . . |
|---|---|---|---|---|---|
| PRINT OPERATION | FIRST (FIG.4) | SECOND (FIG.6) | FIRST (FIG.4) | SECOND (FIG.6) | |

FIG. 8

| NO. OF PRINTED PAGES | 1~15 | 16~20 | 21~35 | 36~40 | . . . |
|---|---|---|---|---|---|
| PRINT OPERATION | FIRST (FIG.4) | SECOND (FIG.6) | FIRST (FIG.4) | SECOND (FIG.6) | |

FIG. 9

| PRINT TIME(h) | 0~12 | 12~15 | 15~27 | 27~30 | . . . |
|---|---|---|---|---|---|
| PRINT OPERATION | FIRST (FIG.4) | SECOND (FIG.6) | FIRST (FIG.4) | SECOND (FIG.6) | |

INK-JET RECORDER AND METHOD FOR CLEANING RESTORING SYSTEM

TECHNICAL FIELD

The present invention relates to an ink-jet recorder that forms an image on a recording medium by ejecting ink from nozzles provided on a recording head.

BACKGROUND ART

A recorder using an ink-jet method, which ejects ink on a recording medium such as recording paper to form an image thereon, is known as one of output devices of an information processing unit such as a computer or a workstation. This ink-jet recorder usually comprises recording heads on each of which ink-ejecting nozzles are provided, a carriage on which the recording heads are mounted and that moves back and forth in a predetermined direction, and a recording medium conveyer that conveys a recording medium in a direction (recording medium conveyance direction) at a right angle to the predetermined direction.

When forming an image on recording paper, the recording paper being conveyed by the recording medium conveyer is temporarily stopped and, while moving back and forth the carriage in the predetermined direction, ink is ejected from the nozzles based on the image signals including image information to form a band of image in the image-forming area, which is opposed to the nozzle exits (ink ejecting outlets), on the recording paper. After that, the recording paper is fed one band and then stopped and, while moving back and forth the carriage again in the predetermined direction, ink is ejected from the nozzles based on the image signals to form another band of image in the image forming area on the recording paper. By repeating such an operation, the whole image is formed on the recording paper.

Because ink (recording liquid) is ejected directly from the recording heads for recording on such an ink-jet recorder, the recording heads must be maintained in the state so that ink may be ejected at any time. This requires a variety of special operations that are not required for other types of recorders.

Suction

When gases, or bubbles, are mixed into a supply path, through which ink is supplied to the nozzles that are ink outlets, or into an ink reservoir (common liquid chamber) near the nozzles and when those bubbles become so large that they prevent ink from being supplied to the nozzles, ink is not ejected properly. To solve this problem, the ink and bubbles present in the area leading to, and included in, the common liquid chamber, are sucked and removed by applying a negative pressure to the nozzle surface. This operation is called suction. As will be described below, the sucking operation is also performed, with the caps removed from the heads, to remove ink accumulated in the caps by a preliminary ejection. (The suction described in the present invention is the latter suction).

Wiping

Physical matters (paper powder, ink, etc.), which are adhered to the nozzle arrangement surface (face side) and prevent ink ejection, sometimes prevent ink from being ejected properly. To remove those physical matters, a flexible blade member such as a rubber blade member is used to wipe the face side. This operation is called a wiping operation. Means for performing the wiping operation is called a wiper.

Preliminary Ejection

Not all nozzles are used to eject ink during image formation. Therefore, ink on the nozzles from which ink is not ejected dries and those nozzles sometimes prevent link from being ejected. An operation that ejects ink to a part other than recording paper at an interval of predetermined time to prevent ink from being dried for ensuring good-quality images is a preliminary ejection. This operation is also called a "pre-ejection".

Capping

An operation that covers the face side with a cap during non-printing time to prevent ink in the nozzles from being dried is called a capping operation. Absorptive matters soaked to some degree with sucked ink are included in the cap to prevent drying.

It should be noted that pre-ejection during printing is generally executed little by little under time control and therefore a small amount of ink is accumulated in a cap over a relatively long time period. In addition, even if the operation is performed to suck accumulated ink when there is not an enough ink region in the absorptive matter in the cap, air is sucked and therefore residual ink remains in the cap. For this reason, the viscosity of ink in the cap or in the suction pump increases (viscosity increase) and, as a result, the ink adheres to the cap, to the suction pump, and to the ink path through which ink flows to the waste ink tank.

Some of the ink adhered to the suction pump or the ink flow path is re-dissolved by the sucking operation and is sent to the waste ink tank. However, there could be a possibility that the adhered ink eventually blocks the flow path, causes a pump failure, or causes the ink ejected in the cap to overflow. This problem is most noticeable when pigmented ink, which is highly water-resistant, is used because it is difficult to re-dissolve.

In view of the foregoing, it is an object of the present invention to provide an ink-jet recorder and its restoring system cleaning method that prevent ink adhesion from occurring in the restoring system and that perform the sucking operation and the pre-ejection operation smoothly.

DISCLOSURE OF THE INVENTION

A method for cleaning a restoring system according to the present invention is a method for cleaning a restoring system of an ink-jet recorder that ejects ink droplets from nozzles on a recording head to record on recording paper, comprising the steps of counting an accumulated number of times ink is preliminarily ejected from the nozzles on the recording head into a cap where waste ink is stored; when executing a sucking operation at a predetermined time to suck ink that has been ejected into the cap, successively ejecting ink into the cap a number of times equal to a difference between a predetermined count value and the accumulated number of times; and executing the sucking operation to suck ink stored in the cap.

An ink-jet recorder according to the present invention comprises a recording head for ejecting ink droplets from nozzles for recording on recording paper; a cap for preventing the nozzles from being dried; preliminary ejection means for bringing, at non-print time, the ink-jet recording head to a position opposed to the cap to eject the ink droplets from the nozzles to prevent bad printing; ink suction means connected to the cap for sucking ink stored in the cap; counting means for counting a number of times ink is ejected from the nozzles to the cap; and control means for successively ejecting ink into the cap a number of times equal to a difference between a predetermined count value and an accumulated count of times when executing the sucking operation at a predetermined time to suck ink that has been ejected into the cap and then executing the sucking operation to suck ink stored in the cap.

The method and the recorder according to the present invention as described above let some amount of ink flow into the ink flow paths at least before printing or at the end of printing, with no major reconfiguration of a conventional restoring knit, to prevent ink from adhering to the components of the restoring system.

In another aspect, a method for cleaning a restoring system according to the present invention is a method for cleaning a restoring system of an ink-jet recorder that ejects ink droplets from nozzles on a recording head to record on recording paper, wherein a sucking operation to suck waste ink from a cap is executed, after printing, until ink is discharged from an ink flow path provided in a downstream of the cap and wherein the sucking operation is executed, immediately before or during printing, to such an extent that ink is discharged from the cap but remains in the ink flow path.

This allows ink, which was put out before printing, to remain in the flow paths, dissolves ink adhered to the ink flow paths during printing, and lets the dissolved ink flow at the end of printing, thus solving the problem of adhered ink generated during long-time storage. As a result, the sucking operation and the preliminary ejection operation may be performed smoothly for a long time and good-quality images are ensured.

In still another aspect, a method for cleaning a restoring system according to the present invention is a method for cleaning a restoring system of an ink-jet recorder that ejects ink droplets from nozzles on a recording head to record on recording paper, wherein, when an ink preliminary ejection operation is executed at a predetermined time, a first preliminary ejection operation, which is an operation for preventing nozzles from being dried, and a second preliminary ejection operation, which is an operation for ejecting ink more times than a count value of the first preliminary ejection operation, are switched or alternately performed at a predetermined interval.

Another ink-jet recorder according to the present invention comprises a recording head for ejecting ink droplets from nozzles for recording on recording paper; a cap for preventing the nozzles from being dried; preliminary ejection means for bringing, at non-print time, the ink-jet recording head to a position opposed to the cap to eject the ink droplets from the nozzles to prevent bad printing; ink suction means connected to the cap for sucking ink stored in the cap; judging means for judging predetermined judgment data based on a predetermined criterion, the judgment data being collected, in advance, for the judgment; and control means for switching a first print operation and a second print operation for execution based on a judgment result of the judging means, the first print operation involving a first preliminary ejection operation that preliminarily ejects a predetermined amount of ink at least before starting printing or after printing, the second print operation involving a second preliminary ejection operation that preliminarily ejects more ink than the predetermined amount at least before starting printing or after printing.

As described above, switching the first print operation and the second print operation, which differ in the amount of preliminarily ejected ink, based on a predetermined criterion allows some amount of ink to be regularly supplied to the ink flow paths at least before printing and at the end of printing. This prevents ink from adhering to the restoring system components.

Switching at the predetermined interval is performed when the number of accumulated dots printed during printing reaches a predetermined number of dots, when the number of printed pages printed during printing reaches a predetermined number of forms, or when the print time used for printing reaches a predetermined time.

BRIEF DESCRIPTION OF THE DRAWINGS

FIG. 7 is a diagram showing a criterion used to switch the first print operation and the second print operation according to the dot count in the third embodiment of the present invention;

FIG. 8 is a diagram showing a criterion used to switch the first print operation and the second print operation according to the number of printed pages in the third embodiment of the present invention;

FIG. 9 is a diagram showing a criterion used to switch the first print operation and the second print operation according to the print time (h) in the third embodiment of the present invention.

BEST MODE FOR CARRYING OUT THE INVENTION

Some embodiments of the present invention will be described in detail below with reference to the drawings.

Figure 1:
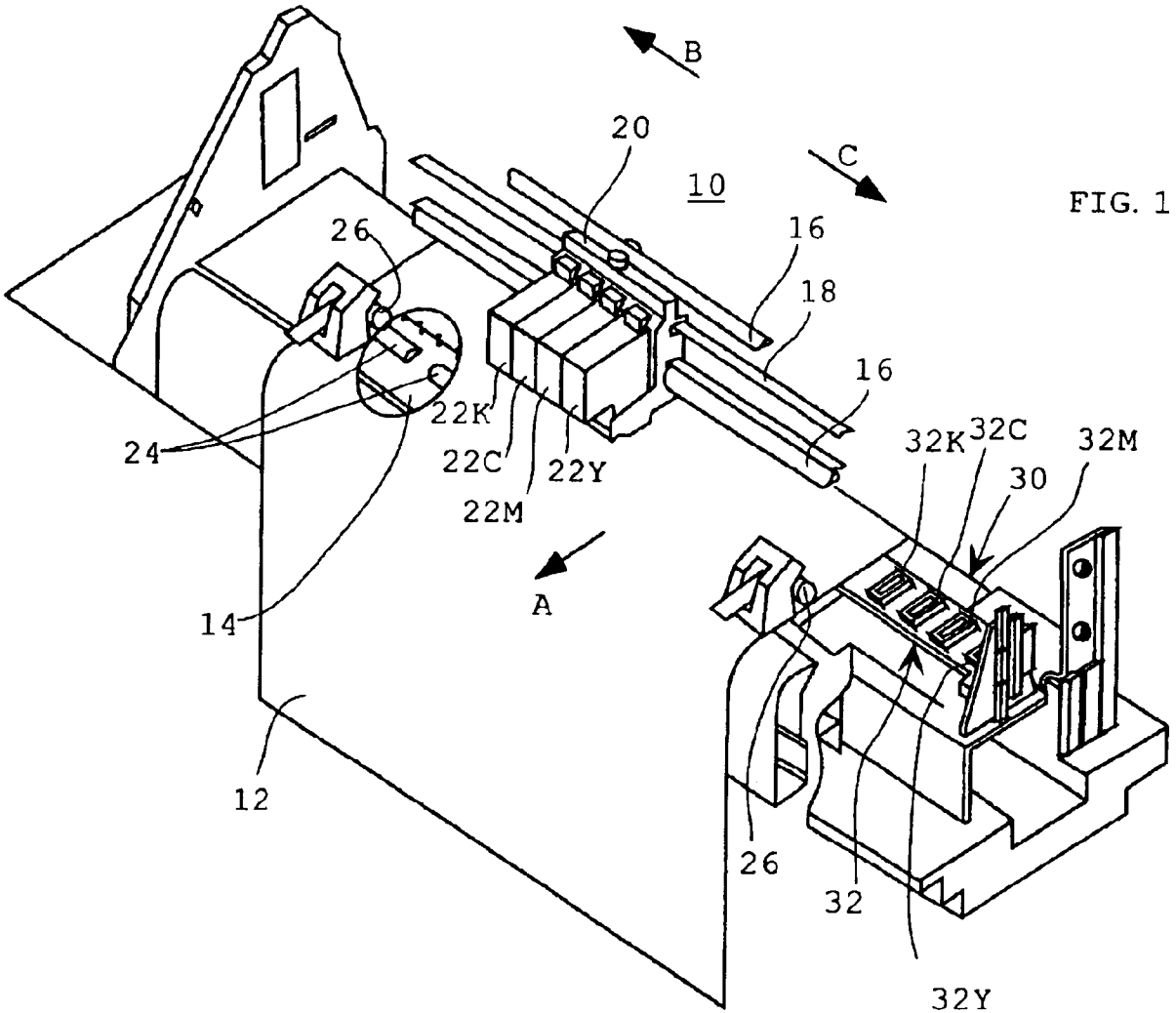
FIG. 1 is a perspective illustration showing the general external configuration of an ink-jet plotter in an embodiment of the present invention.

With reference to FIG. 1, a plotter that is one example of an ink-jet recorder according to the present invention will be described. FIG. 1 is a perspective view showing the general external configuration of the plotter.

A plotter 10 has a platen 14 on which recording paper 12 conveyed in the direction of arrow A is placed. Above this platen 14 are provided two scan rails (guide rails) 16 that run in parallel with the platen 14. On these scan rails 16, a carriage 20 that is moved back and forth by a motor (not shown) and a belt 18 in directions of arrows B and C (at right angles with the direction of arrow A) is mounted via the slide bearing (not shown).

The carriage 20 has four recording heads 22K(black), 22C(cyan), 22M (magenta), and 22Y(yellow) each having nozzle outlets (nozzle exits: not shown) from which ink is ejected. In front of those ink outlets, an image formation area, whose band width is almost equal to the nozzle column length, is supposed to be on the recording paper 12. Ink is ejected from the ink outlets to the image formation area to form one band of image in this part.

At one end of the range in which the carriage 20 can move and at a position distant from the image formation area, a restoring device 30 is provided. This device forcibly sucks ink from the nozzles to clean the ink supply paths and the nozzles on the recording heads 22 and to restore the ink ejection status of the recording heads 22 to the initial ejection status. The restoring device 30 has four rubber caps 32K, 32C, 32M, and 32Y each of which removably covers the corresponding nozzle exit of the four recording heads 22K, 22C, 22M, and 22Y. One end of a tube (not shown) is connected to each of the caps 32K, 32C, 32M, and 32Y, and the other end of the tube is connected to a suction pump (not shown). The four caps 32K, 32C, 32M,and 32Y are fixed on the cap holder 32.

When forming an image on the recording paper 12 such as roll paper, the recording paper 12 is placed on the platen 14 and, with the recording paper 12 held between a conveyance roller 24 that has a part of its periphery exposed from the opening provided on the platen 14 and pinch rollers 26 that hold both ends of the recording paper 12, the conveyance roller 24 is rotated by a motor (not shown) to convey the recording paper 12.

On the other hand, the carriage 20 is moved back and forth above the recording paper 12 in the direction of arrows B and C and, based on the image signal including image information sent from a head controller 130 (refer to FIG. 3) to the recording heads 22K, 22C, 22M, and 22Y, ink is ejected from the nozzles to form an image in one band of the image formation area on the recording paper 12. When it is required during the image formation operation to suck ink from the nozzles to clean the nozzles, the carriage 20 is moved to a position above the restoring device 30 to execute a predetermined restoration operation. When image formation is finished, a cutter (not shown) provided on the carriage 20 is extended to a predetermined position to cut the recording paper 12 to a predetermined length.

Figure 2:
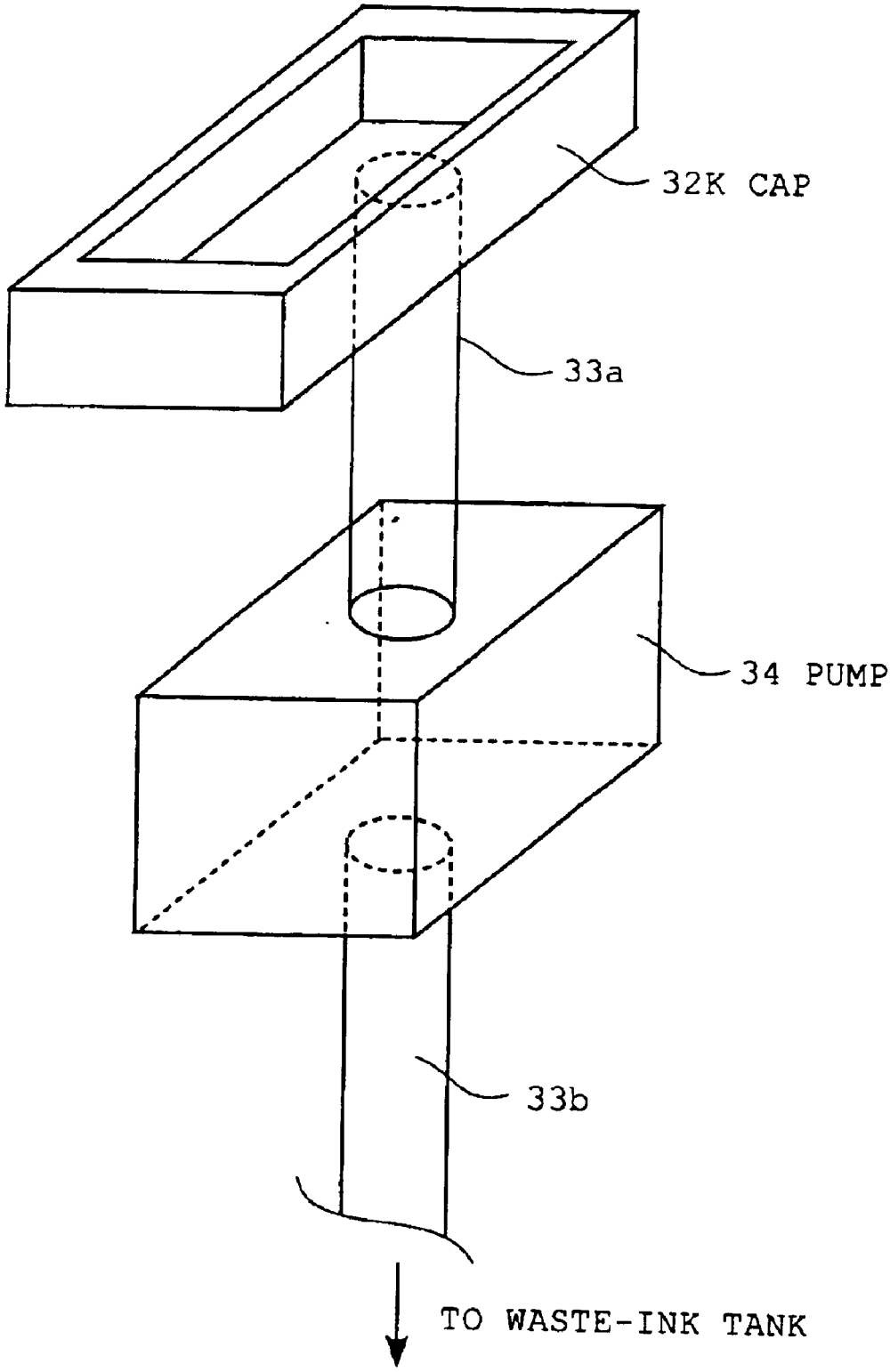
FIG. 2 is a schematic diagram showing a cap and the corresponding pump of one of ink colors of the restoring system shown in FIG. 1.

FIG. 2 is a schematic diagram showing the cap 32K and the corresponding pump 34 for one ink color (for example, black) of the restoring device 30 shown in FIG. 1. One end of an ink flow path 33*a* is connected to the bottom of the cap 32K, and the other end to the pump 34. In addition, one end of another ink flow path 33*b* is connected to the bottom of the pump 34. The other end of the ink flow path 33*b* is connected to a waste ink tank that is not shown.

Figure 3:
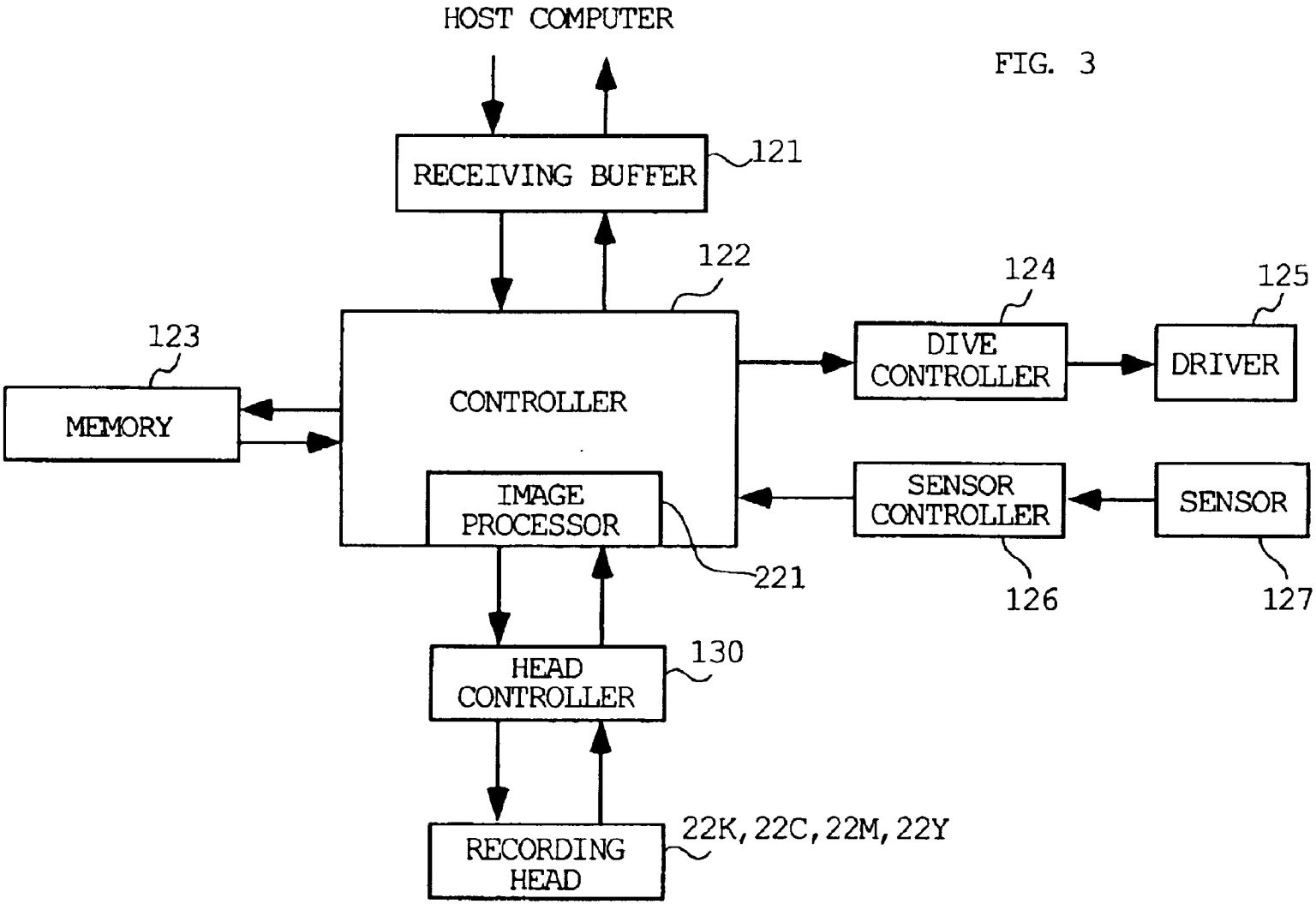
FIG. 3 is a block diagram showing the general configuration of the control hardware of the ink-jet plotter shown in FIG. 1.

FIG. 3 is a block diagram showing the general configuration of the control hardware of the ink-jet plotter described above. Image data transferred from a host computer is once held in a receiving buffer 121 of the recorder. Conversely, data indicating whether or not data has been transferred correctly and data indicating the operation status of the recorder are transferred from the recorder to the host computer. Data held in the receiving buffer 121 is transferred to a memory 123 under control of a controller 122, which has a CPU or the like, and stored there temporarily.

In response to commands from the controller 122, a drive controller 124 controls the driving of the carriage motor that moves the carriage and the conveyance motor t hat conveys the recording materials. At the same time, the drive controller controls a driver 125 that performs restoration operations such as suction and wiping. A sensor controller 126 sends the signals from a sensor unit 127, which is composed of various sensors and the switches (SW) for sensing the ambient temperature and humidity, to the CPU in the controller 122. The head controller 130 controls the driving of the recording heads 22K, 22C, 22M, and 22Y in response to commands from an image processor 221 in the controller 122. In addition, the head controller sends information indicating the status of the recording heads, such as temperature information, to the controller 122.

Figure 4:
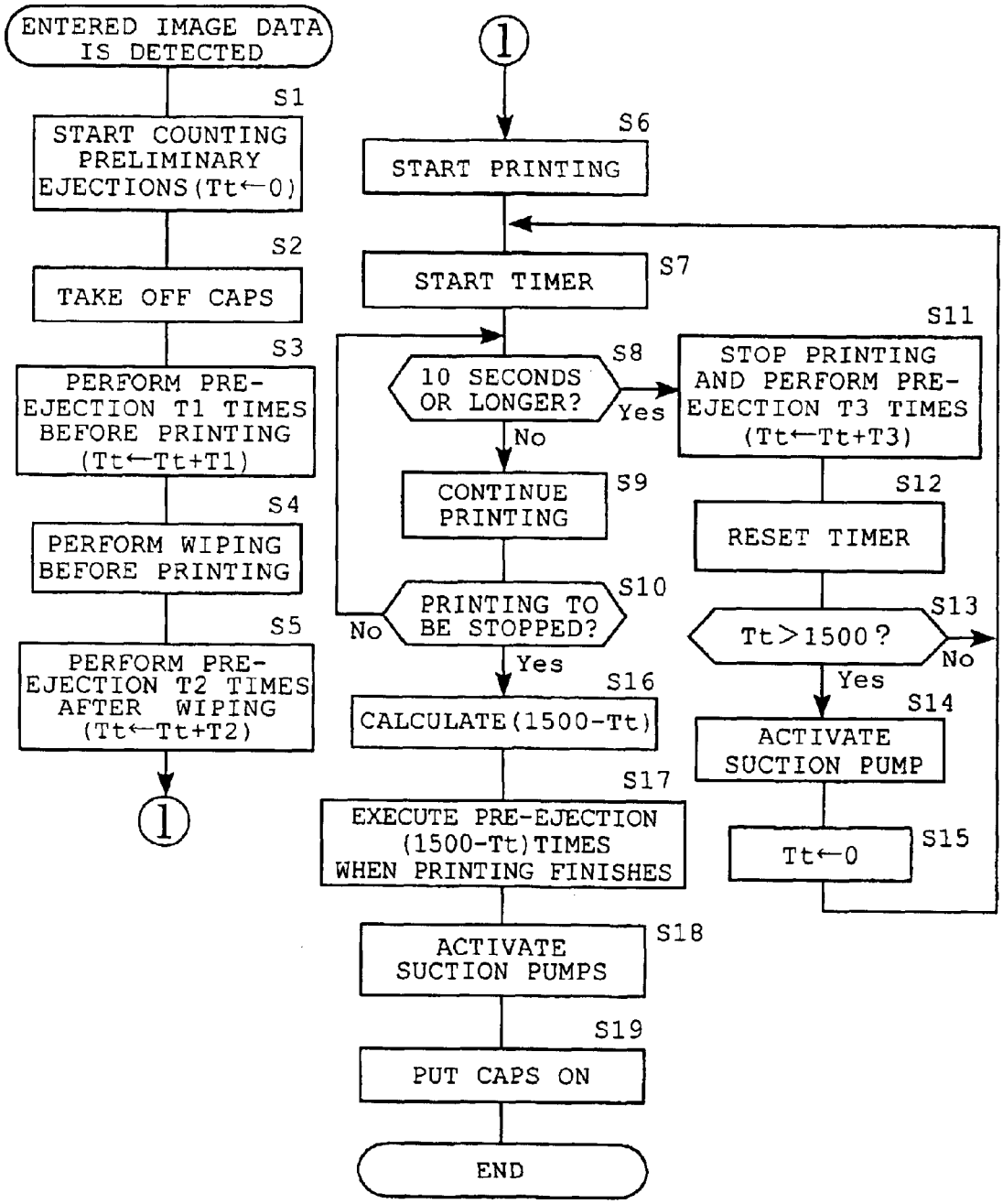
FIG. 4 is a flowchart showing the print operation of an ink-jet plotter in a first embodiment of the present invention.

FIG. 4 is a flowchart showing the print operation of an ink-jet plotter in a first embodiment of the present invention. This processing is executed individually for each recording head. This operation is started when image data is entered. First, preliminary ejection counting is started to count the number of pre-ejections (S1). That is, the preliminary ejection count value Tt is set to 0. Next, the caps are moved away from the heads (S2) and, above the caps, preliminary ejection is performed the predetermined number of times, T1, before printing (S3) At this time, Tt is incremented by T1. Next, the wiping operation is performed before printing (S4) and preliminary ejection is performed again T2 times (S5) after wiping. At this time, Tt is incremented by T2.

After completing those operations, the print operation is started (S6). A timer counting operation starts (S7) to manage the print time from this time on. Printing continues (S9) until a predetermined print time (for example, 10 seconds) elapses (S8, No). Each time the predetermined print time elapses (Yes in S8) printing is stopped, the heads are moved to the position above caps, and preliminary ejection is performed the predetermined number of times, T3, to prevent the ink in the nozzles from being dried (S1). At this time, Tt is incremented by T3. The time count is reset (S12). Then, if the counts of pre-ejections (total of pre-ejections) exceed a predetermined number of times (Yes in S13), the suction pump is activated to suck ink (S14). The predetermined number of times, which is, for example, the number of times necessary for the caps to be filled with ink, is 1500 in this example. Because the caps get empty after suction, Tt is reset to 0 (S15). If Tt is equal to or less than the predetermined number of times in step S13, control is passed back to step S7 for continued printing.

When printing finishes (Yes in S10) 1500 minus the current number of preliminary ejections Tt, that is, the difference between the predetermined count value and the accumulated count value (1500−Tt) is calculated (S16). Then, pre-ejection is executed for the caps the number of times equal to the difference (S17). After that, ink is sucked by the pumps to let ink flow through the caps and the ink paths (S18). After that, the caps are put on the heads (S19) to end the operation shown in FIG. 4.

Because the configuration and the operation described above completely discharge ink remaining in the caps each time one image is formed, the ink flow paths and the suction pumps, free of high-viscosity ink, can be kept clean.

Figure 5:
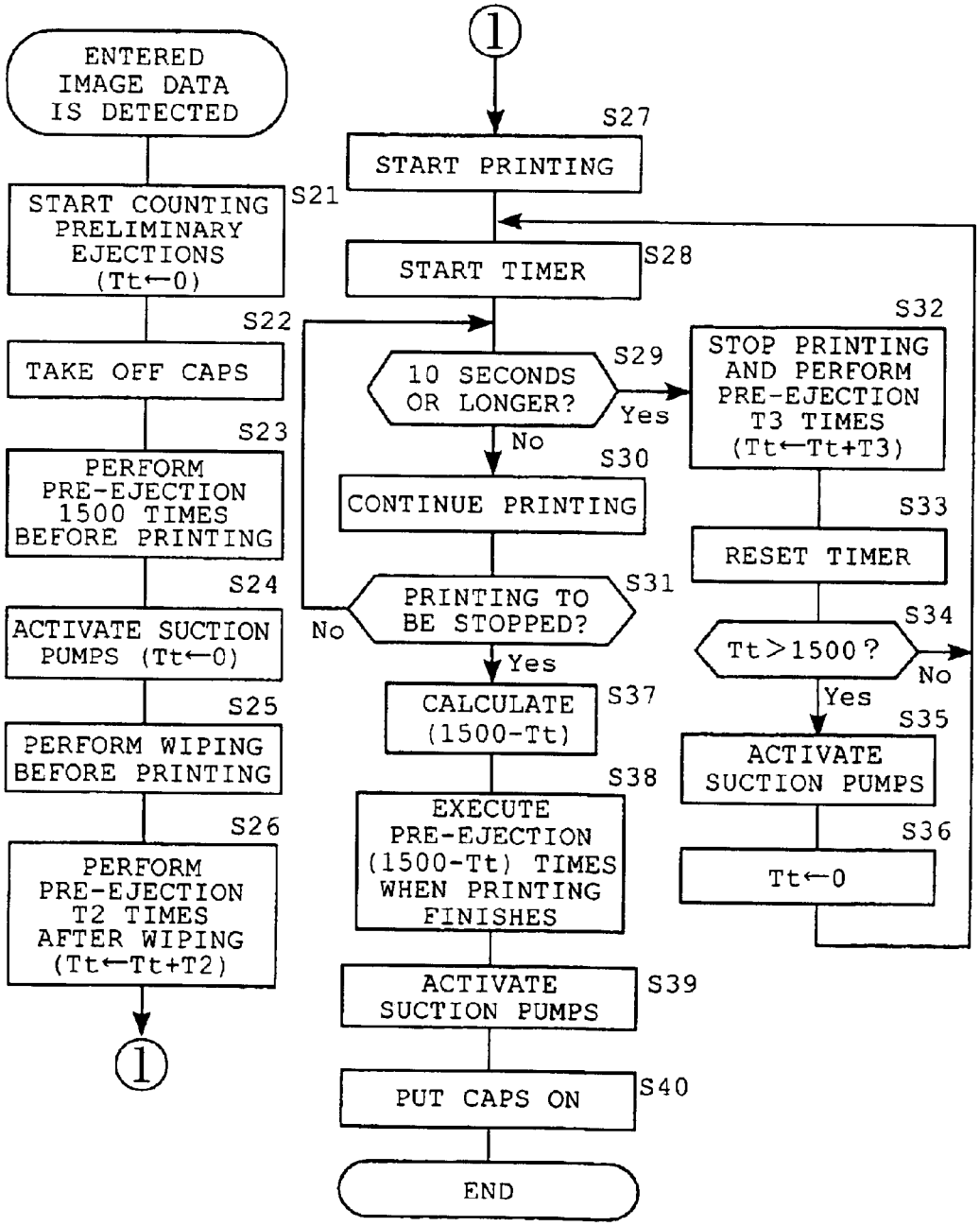
FIG. 5 is a flowchart showing the print operation of an ink-jet plotter in a second embodiment of the present invention.

FIG. 5 is a flowchart showing the print operation of an ink-jet plotter in a second embodiment of the present invention. The configuration of the main body is as shown in FIGS. 1–3. Basically, the operation of S21–S40 in FIG. 5 is similar to that of S1–S19 in FIG. 4. The following describes only the difference between them.

The processing shown in FIG. 5 differs from the processing shown in FIG. 4 in the amount of before-printing pre-ejection (S23) that is performed after the caps are taken off before printing. That is, in this embodiment, preliminary ejection is performed 1500 times (S23). The amount of ink corresponding to 1500 preliminary ejections is the maximum amount of ink that maybe stored in the caps. After that, the suction pump operation is activated (S24). The amount of ink that is sucked by the suction pumps equals the total amount of ink in the caps but, actually, ink is sucked to such an extent that part (for example, half) of sucked ink remains in the ink restoring system components, for example, in the ink flow paths and suction pumps. Keeping viscosity-free ink in this way in the restoring system components, where viscosity easily increases as it gets dry, prevents ink adhesion caused as the ink dries and, at the same time, solves the problem of high-viscosity ink caused by leaving ejected ink unattended (for example, re-dissolution). In addition, letting ink flow from the restoring system at a time at the end of printing keeps the restoring system components clean.

The print operation in the first and second embodiments described above may be performed at print operation time and/or at any predetermined time. For example, predetermined times are when a predetermined number of forms are output, when a predetermined time arrives, when the head is replaced, and when an ink tank is replaced.

In the embodiments described above, letting viscosity-free ink flow through the restoring system components, such as ink flow paths and suction pumps, after printing allows the ink pre-ejected during printing to flow smoothly. Alternatively, letting viscosity-free ink flow into the restoring system components, such as ink flow paths and suction pumps, before printing re-dissolves high-viscosity ink to wash it away at the end of printing. This prevents ink from adhering to the restoring system components, prolongs the life of restoring parts, and gives good-quality images. The present invention is most advantageously applied to an ink-jet recorder using pigmented ink.

Next, a third embodiment of the present invention will be described. In the third embodiment, the processing in FIG. 4 and the processing in FIG. 6, which will be described, are switched for execution at a predetermined interval.

Figure 6:
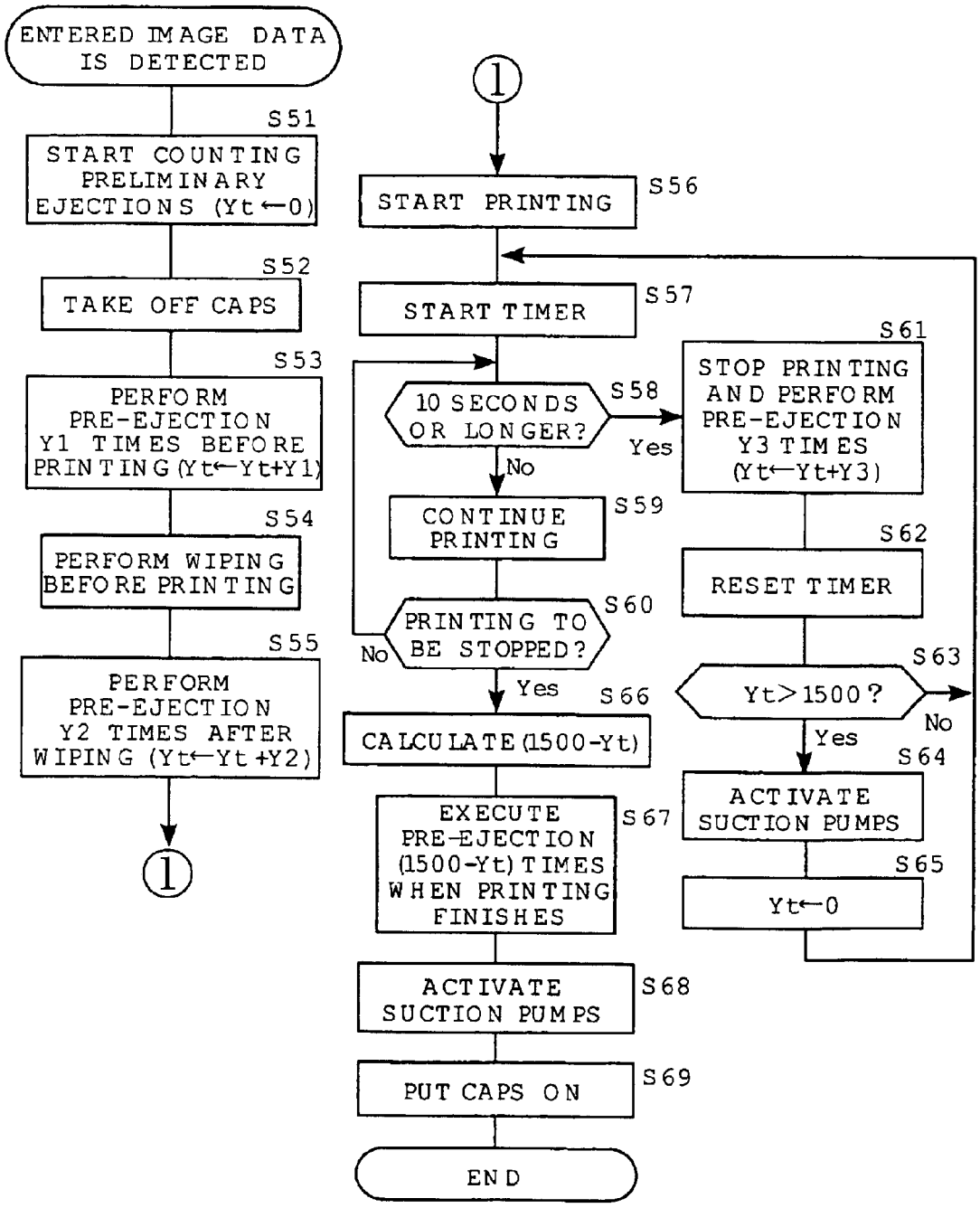
FIG. 6 is a flowchart showing the cleaning operation of the restoring system of an ink-jet plotter in a third embodiment of the present invention.

FIG. 6 is a flowchart showing the cleaning operation of the restoring system of an ink-jet plotter in this embodiment. Basically, the operation of steps S51–S69 is the same as that of steps S1–S19 in FIG. 4. The difference is that the numbers of pre-ejections T1, T2, and T3 are increased to Y1, Y2, and Y3 (2–20 times), respectively, to prevent ink in the caps from drying and, at the same time, increases the number of times the suction pumps are activated during printing. This makes it possible to wash away the ink in the restoring system components that would not be washed away during the normal print operation shown in FIG. 4.

The first print operation (normal print operation) involving the first pre-ejection shown in FIG. 4 and the second print operation (restoring system cleaning operation) involving the second pre-ejection operation shown in FIG. 6 may be switched for execution at a predetermined interval under predetermined conditions. The predetermined conditions include the following.

First, the first print operation and the second print operation are switched alternately according to the dot count as shown in FIG. 7. To do so, means for counting dots is provided. In this example, the dot count range in which the first print operation is executed is wider than the dot count range in which the second print operation is executed. This may reduce the amount of waste ink during normal print operation.

Second, as shown in FIG. 8, the first print operation and the second print operation are switched alternately according to the number of printed pages. To do so, means for counting printed pages is provided. Again, in this example, the number-of-printed-pages range in which the first print operation is executed is wider than the number-of-printed-pages range in which the second print operation is executed.

Third, as shown in FIG. 9, the first print operation and the second print operation are switched alternately according to the print time (h). To do so, means for measuring the print time is provided. Again, in this example, the print time range in which the first print operation is executed is wider than the print time range in which the second print operation is executed.

Figure 10:
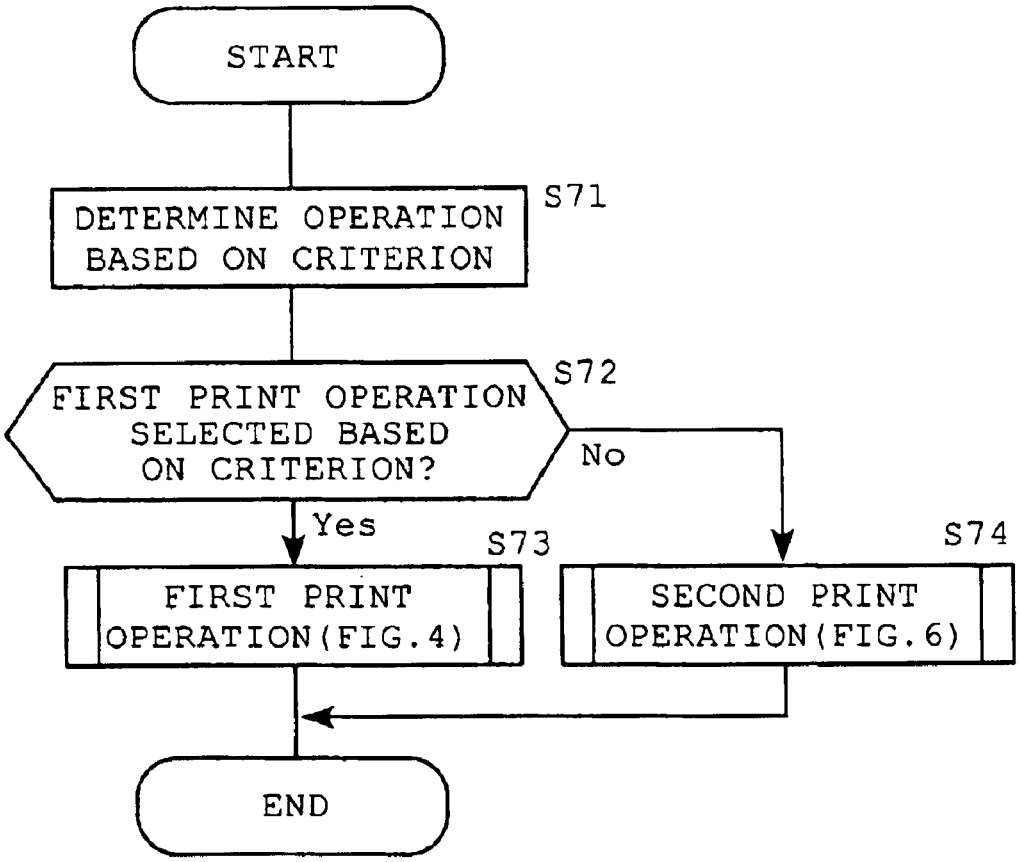
FIG. 10 is a flowchart showing how the first print operation and the second print operation are switched in the third embodiment of the present invention.

FIG. 10 shows a flowchart showing processing in which the first print operation and the second print operation are switched. This processing is executed for each print operation. Which print operation, the first or the second, is to be executed is judged based on the determination data such as the number of print dots, the number of printed pages, or the print time (S41). In the former case (Yes in S42), the first print operation is selected (S43), and in the latter case, the second print operation is selected (S44).

While the preferred forms of the present invention have been described, it is to be understood that changes and variations may be made. For example, the number of pre-ejections or the number of seconds is illustrative only and therefore the present invention is not limited to those specific values.

According to the embodiments, based on the criterion such as the number of ejection dots, the number of printed pages, or the print time, the first print operation in which a normal preliminary ejection is performed and the second print operation in which a larger amount of ink is ejected during preliminary ejection are executed alternately. This prevents ink from adhering to the restoring system components, prolongs the life of restoring parts, and gives good-quality images.

INDUSTRIAL APPLICABILITY

The present invention may be applied to the design, development, and manufacturing of an ink-jet recorder.

What is claimed is:

1. A method for cleaning a restoring system of an ink-jet recorder that ejects ink droplets from nozzles on a recording head to record on recording paper, comprising the steps of:

counting an accumulated number of times ink is preliminarily ejected from the nozzles on said recording head into a cap where waste ink is stored;

when executing a sucking operation to suck ink that has been ejected into the cap at a predetermined time, successively ejecting ink into the cap a number of times equal to a difference between a predetermined count value and the accumulated number of times;

and executing the sucking operation to suck ink stored in the cap.

2. The method for cleaning a restoring system according to claim 1, wherein the predetermined time is a time after printing by said recording head is finished.

3. The method for cleaning a restoring system according to claim 1, wherein the predetermined time is a time before printing by said recording head is started.

4. The method for cleaning a restoring system according to claim 1, wherein the predetermined count value corresponds to an amount almost equal to a full capacity of the cap.

5. The method for cleaning a restoring system according to claim 1, wherein the preliminary ejection is executed even during printing and wherein the preliminary ejection during printing is executed by suspending the printing each time a predetermined time elapses.

6. A method fox cleaning a restoring system of an ink-jet recorder that ejects ink droplets from nozzles on a recording head to record on recording paper, the method comprising the steps of:

immediately before or during printing, performing a sucking operation to suck waste ink from a cap to such an extent that ink is discharged from the cap but remains in an ink flow path provided in a downstream of the cap, and after printing, performing a sucking operation until ink is discharged from an ink flow path.

7. A method for cleaning a restoring system of an ink-jet recorder that ejects ink droplets from nozzles on a recording head to record on recording paper, when a print operation is performed with an ink preliminary ejection operation which is executed at predetermined time points at least before starting the print operation and during a print operation, the method comprising the steps of:

performing a first print operation, accompanied by a first preliminary ejection operation for ejecting ink in amount of a first count value per one preliminary ejection operation; and performing a second print operation alternately with said first print operation at a predetermined interval according to a predetermined conditon, said second print operation being accompanied by a second preliminary ejection operation for ejecting ink in amount of a second count value that is greater than the first count value.

8. The method for cleaning a restoring system according to claim 7, wherein when an accumulated number of dots printed during printing reaches a first number of dots the first print operation is switched to the second print operation and wherein when an accumulated number of dots printed during printing reaches a second number of dots that is smaller than the first number of dots the second print operation is switched to the first print operation.

9. The method for cleaning a restoring system according to claim 7, wherein when a number of printed pages printed during printing reaches a first number of pages the first print operation is switched to the second print operation and wherein when a number of printed pages printed during printing reaches a second number of pages that is smaller than the first number of pages the second print operation is switched to the first print operation.

10. The method for cleaning a restoring system according to claim 7, wherein when a print time used for printing during printing reaches a first time period the first print operation is switched to the second print operation and wherein when a print time used for printing during printing reaches a second time period that is smaller than the first time period the second print operation is switched to the first print operation.

11. An ink-jet recorder comprising:

a recording head for ejecting ink droplets from nozzles for recording on recording paper;

a cap for preventing the nozzles from being dried;

preliminary ejection means for bringing, at non-print time, said ink-jet recording head to a position opposed to said cap to eject the ink droplets from the nozzles to prevent bad printing;

ink suction means connected to said cap for sucking ink stored in said cap;

counting means for counting a number of times ink is ejected from said nozzles to said cap; and control means for successively ejecting ink into the cap a number of times equal to a difference between a predetermined count value and an accumulated count of times when executing a sucking operation at a predetermined time to suck ink that has been ejected into the cap and then executing the sucking operation to suck ink stored in the cap.

12. The ink-jet recorder according to claim 11, wherein the predetermined count value corresponds to an amount almost equal to a full capacity of the cap.

13. An ink-jet recorder comprising:

a recording head for ejecting ink droplets from nozzles for recording on recording paper;

a cap for preventing the nozzles from being dried;

preliminary ejection means for bringing, at non-print time, said ink-jet recording head to a position opposed to said cap to eject the ink droplets from the nozzles to prevent bad printing;

ink suction means connected to said cap for sucking ink stored in said cap;

judging means for judging predetermined judgment data based on a predetermined criterion, said judgment data being collected, in advance, for the judgment; and control means for switching a first print operation and a second print operation when a print operation is to be performed with an ink preliminary ejection operation which is executed at predetermined time points at least before starting the print operation and during a print operation, a first print operation with a first print operation and a second print operation are switched at a predetermined interval according to a result of the judgment, said first print operation being accompanied by a first preliminary ejection operation for ejecting ink in amount of a first count value per one preliminary ejection operation, and said second print operation being accompanied by a second preliminary ejection operation for ejecting ink in amount of a second count value that is greater than the first count value.

14. The ink-jet recorder according to claim 13, wherein the judgment data is an accumulated number of dots printed during print operation, a number of printed pages, or a printed time.

* * * * *